US007980223B2

(12) United States Patent
Ricco et al.

(10) Patent No.: US 7,980,223 B2
(45) Date of Patent: Jul. 19, 2011

(54) ACCUMULATION-VOLUME FUEL INJECTION SYSTEM FOR AN INTERNAL-COMBUSTION ENGINE

(75) Inventors: Mario Ricco, Valenzano (IT); Sisto Luigi De Matthaeis, Valenzano (IT); Raffaele Ricco, Valenzano (IT); Domenico Lepore, Valenzano (IT)

(73) Assignee: C.R.F. Societa Consortile per Azioni, Orbassano (IT)

( * ) Notice: Subject to any disclaimer, the term of this patent is extended or adjusted under 35 U.S.C. 154(b) by 212 days.

(21) Appl. No.: 12/261,650

(22) Filed: Oct. 30, 2008

(65) Prior Publication Data

US 2009/0050110 A1 Feb. 26, 2009

Related U.S. Application Data

(63) Continuation of application No. 11/113,502, filed on Apr. 25, 2005, now Pat. No. 7,444,988.

(30) Foreign Application Priority Data

Nov. 12, 2004 (EP) ..... 04425839

(51) Int. Cl.
*F02M 37/04* (2006.01)

(52) U.S. Cl. ..... 123/446

(58) Field of Classification Search ..... 123/446, 123/456, 514, 447, 458, 500, 457, 510, 511
See application file for complete search history.

(56) References Cited

U.S. PATENT DOCUMENTS

| | | | | |
|---|---|---|---|---|
| 5,345,916 | A | 9/1994 | Amann et al. | |
| 6,135,090 | A | 10/2000 | Kawachi et al. | |
| 6,343,588 | B1 * | 2/2002 | Onishi et al. | 123/506 |
| 6,523,526 | B2 | 2/2003 | Schwarz | |
| 6,609,500 | B2 | 8/2003 | Ricco et al. | |
| 6,694,950 | B2 | 2/2004 | Djordjevic | |
| 6,748,923 | B2 | 6/2004 | Grossner et al. | |
| 6,792,915 | B2 | 9/2004 | Rembold et al. | |
| 6,823,847 | B2 | 11/2004 | Carlo | |
| 6,889,657 | B2 | 5/2005 | Ruesseler et al. | |
| 7,182,067 | B2 * | 2/2007 | Ricco et al. | 123/446 |
| 7,228,844 | B2 * | 6/2007 | Ricco et al. | 123/446 |
| 7,395,812 | B2 * | 7/2008 | Ricco et al. | 123/446 |
| 7,444,988 | B2 * | 11/2008 | Ricco et al. | 123/446 |
| 7,779,815 | B2 * | 8/2010 | Ricco et al. | 123/446 |
| 2001/0015200 | A1 | 8/2001 | Mori | |
| 2001/0025626 | A1 | 10/2001 | Antonioli et al. | |
| 2002/0096145 | A1 | 7/2002 | Ricco et al. | |

FOREIGN PATENT DOCUMENTS

| | | |
|---|---|---|
| EP | 0 507 191 | 10/1992 |
| EP | 1 273 797 | 1/2003 |
| WO | 03/016705 | 2/2003 |

* cited by examiner

*Primary Examiner* — Hai H Huynh

(74) *Attorney, Agent, or Firm* — Michael Best & Friedrich LLP

(57) ABSTRACT

The injection system comprises a pump designed to send fuel at high pressure to an accumulation volume, for example formed by a common rail, for supplying a plurality of injectors. The pump comprises at least one pumping element actuated with reciprocating motion with a compression stroke at a sinusoidal speed, in synchronism with each step of fuel injection. The injection system comprises at least one by-pass solenoid valve, which is controlled by a chopper control unit for modulating the delivery of the pumping element by varying both the instant of start and the instant of end of delivery during the compression stroke, in such a way that the delivery is synchronous with the injection phase.

13 Claims, 3 Drawing Sheets

ACCUMULATION-VOLUME FUEL INJECTION SYSTEM FOR AN INTERNAL-COMBUSTION ENGINE

CROSS-REFERENCE TO RELATED APPLICATIONS

This is a continuation of U.S. patent application Ser. No. 11/113,502 filed on Apr. 25, 2005, which claims the benefit of European Patent Application Serial No. 04 425 839.0, filed on Nov. 12, 2004. The entire contents of these applications are incorporated by reference herein.

FIELD OF THE INVENTION

The present invention relates to an accumulation volume fuel-injection system for an internal-combustion engine.

BACKGROUND

Fuel-injection systems for modern internal-combustion engines in general comprise a pump designed to send fuel at high pressure to a common rail having a pre-determined volume of accumulation of the fuel, for supplying a plurality of injectors associated to the cylinders of the engine. The pump comprises at least one reciprocating-motion pumping element, which each time carries out a suction stroke and a compression or delivery stroke.

As is known, to obtain a good atomization of the fuel, this must be brought to a very high pressure, for example in the region of 1600 bar in the conditions of maximum load of the engine. Recent standards regarding the limits of the pollutants in the exhaust gases of engines require that the pressure of supply of the fuel to the injectors should be reproducible in the most accurate way possible with respect to what is mapped in the electronic control unit. It is possible to limit the oscillations of the pressure in the common rail with respect to what is envisaged if its volume is more than three orders of magnitude greater than the amount of fuel injected by each injector per combustion cycle. The said common rail is in general very cumbersome, and hence its arrangement on the engine proves critical.

For controlling the pressure in the common rail according to what is mapped in the control unit, it has been proposed to set a by-pass solenoid valve on the delivery pipe of the pump towards the common rail, said valve being controlled by an electronic control unit according to various parameters of operation of the engine. It has also been proposed to perform actuation of the pumping element by means of a cam acting in synchronism with the actuation of each injector.

In these known systems, each pumping element has an instantaneous flow rate, the maximum value of which is much smaller than the maximum flow rate of each injector, so that normally, during an injection event, just a part of the fuel injected, in the region of 20%, is supplied by the pump, whilst the remaining part is supplied by the common rail. Consequently, these systems present the drawback of not requiring the presence of a common rail of adequate dimensions. Furthermore, the pump always works at the maximum flow rate, whilst the by-pass solenoid valve simply discharges into the tank the fuel pumped in excess with respect to what is injected by the injectors, with consequent dissipation of thermal energy.

SUMMARY OF THE INVENTION

The purpose of the invention is to provide a fuel-injection system that presents high reliability and eliminates the drawbacks of the systems of the known art, optimizing the performance, and enabling a reduction to the minimum of the volume of accumulation of the fuel between the pump and the injectors.

According to the invention, this purpose is achieved by a fuel-injection system for an internal-combustion engine having a plurality of cylinders, which comprises a pump designed to send fuel at high pressure to an accumulation volume, a plurality of injectors supplied by said accumulation volume and actuatable each for performing a phase of injection of pressurized fuel into a corresponding cylinder of the engine, said injection phase having a maximum flow rate of fuel depending upon the operating conditions of the engine, said pump comprising at least one reciprocating-motion pumping element with a compression stroke for each of said injections, and a by-pass solenoid valve for the fuel sent by said pump into the accumulation volume, wherein the maximum value of the instantaneous flow delivered by said pumping element is of the same order of magnitude as the maximum flow rate of each of said injectors, said by-pass solenoid valve being controlled by a chopper control unit in synchronism with said compression stroke.

In particular, the chopper control unit is designed to control said by-pass solenoid valve in pulse-width modulation (PWM) with a pulse having an instant of start and an instant of end of the delivery during said compression stroke according to the operating conditions of the engine, the modulation being obtained by varying both the instant of start and the instant of end of the delivery, so that said delivery is barycentric with respect to said injection phase.

The invention moreover relates to a high-pressure pump for sending fuel to an accumulation volume designed to supply a plurality of fuel injectors, said pump comprising at least one reciprocating-motion pumping element with a compression stroke, said pumping element having a compression chamber in communication with a delivery pipe and comprising a by-pass solenoid valve set in a position corresponding to said delivery pipe for controlling the amount of fuel sent by said pump into the accumulation volume, wherein the maximum value of the instantaneous flow rate delivered by said pumping element is of the same order of magnitude as the maximum flow rate of each of said injectors, said by-pass solenoid valve being controlled by a chopper control unit in synchronism with the injection phase of said injector.

The purpose of the invention is moreover achieved with a method for controlling the pressure of the fuel in an accumulation volume for a set of fuel injectors in an internal-combustion engine, in which the fuel is supplied to the accumulation volume by at least one reciprocating-motion pumping element with a compression stroke, said method including the following steps: providing said pumping element with a maximum value of the instantaneous flow rate of the same order of magnitude as the maximum flow rate of said injector; providing a by-pass solenoid valve on a delivery pipe of said pumping element; actuating said pumping element during each injection phase of said injector; and controlling said by-pass solenoid valve for modulating the delivery by varying both its instant of start and its instant of end, so that said delivery is barycentric with respect to said compression stroke.

BRIEF DESCRIPTION OF THE DRAWINGS

For a better understanding of the invention two preferred embodiments are herein described, which are provided purely by way of example with the aid of the annexed drawings, in which.

DETAILED DESCRIPTION

Figure 1:
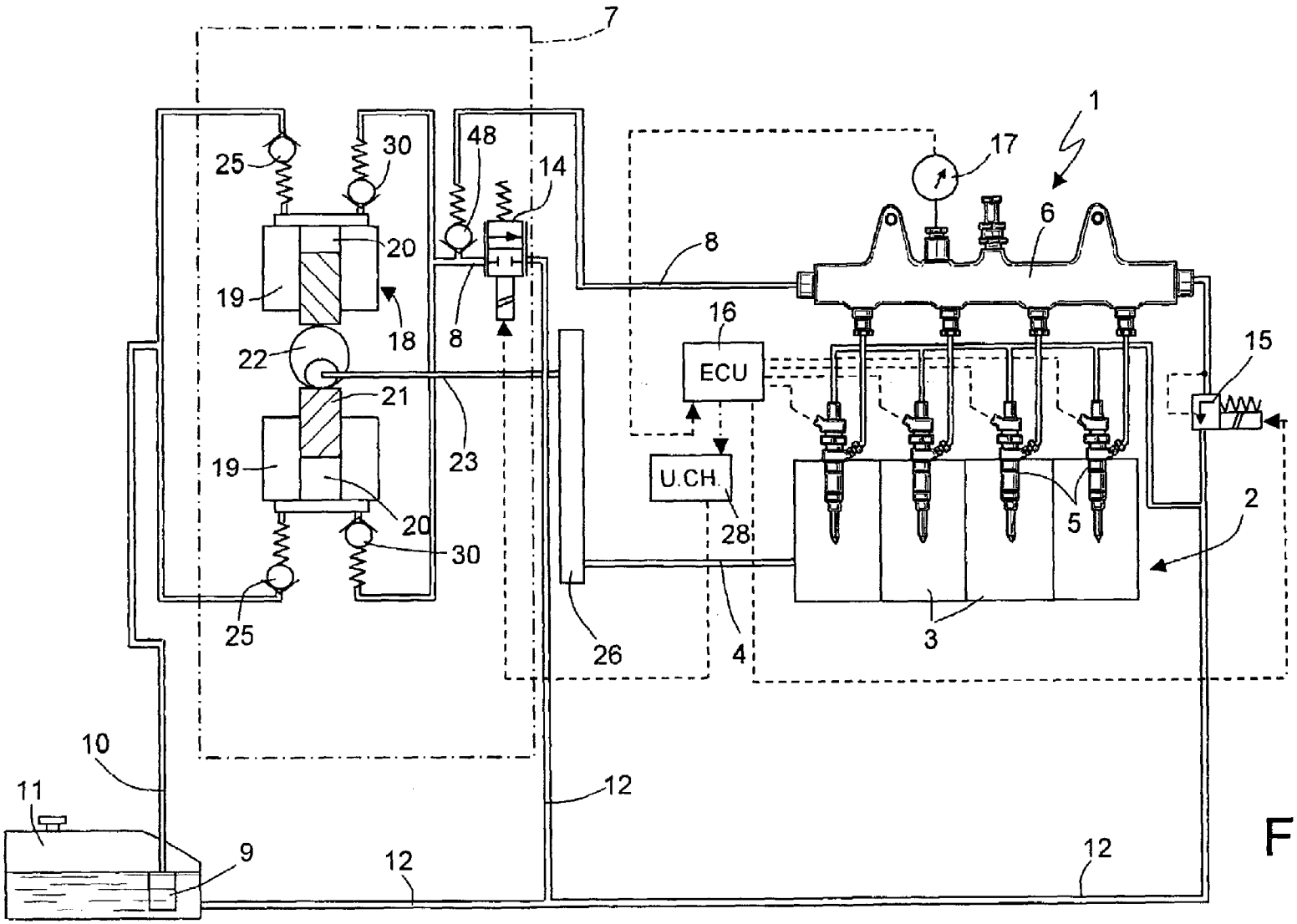
FIG. 1 is a diagram of an accumulation-volume fuel-injection system, according to a first embodiment of the invention.

With reference to FIG. 1, the reference numeral 1 generically designates a fuel-injection system for an internal-combustion engine 2, for example a diesel engine. The engine 2 comprises a plurality of cylinders 3, for example four cylinders, which co-operate with corresponding pistons (not illustrated), actuatable for turning an engine shaft 4.

The injection system 1 comprises a plurality of electrically controlled injectors 5, associated to the cylinders 3 and designed to perform a phase of injection of fuel therein at high pressure for injecting therein the fuel at high pressure. The injectors 5 are connected to an accumulation volume, which has a pre-determined volume for one or more injectors 5. The accumulation volume can also be distributed in the delivery pipe 8 of the pump to the injectors.

In the embodiment illustrated in FIG. 1, the accumulation volume is formed by a common rail 6, to which all the injectors 5 are connected. The common rail 6 is supplied with fuel at high pressure by a high-pressure pump, designated as a whole by 7, via a high-pressure delivery pipe 8. In turn, the high-pressure pump 7 is supplied by a low-pressure pump, for example an electric pump 9, via an intake pipe 10 of the fuel at low pressure.

The electric pump 9 is generally set in the usual fuel tank 11, out of which a pipe 12 extends for discharging fuel in excess of the injection system 1. The discharge pipe 12 conveys towards the tank 11 both the fuel in excess discharged by the injectors 5 and the possible fuel in excess discharged by the common rail 6, when the pressure exceeds the one defined by a regulation solenoid valve 15.

Furthermore, for controlling the pressure of the fuel in the common rail 6, between the high-pressure pump 7 and the tank 11, there is set at least one by-pass solenoid valve 14, which is designed to discharge into the tank 11, through the discharge pipe 12, the possible fuel in excess with respect to what is necessary for maintaining the pressure required in the common rail 6. The by-pass solenoid valve 14 is associated with a non-return valve 48 set on the delivery pipe 8.

In the tank 11, the fuel is at atmospheric pressure. In use, the electric pump 9 compresses the fuel at low pressure, for example in the region of 2-3 bar. In turn, the high-pressure pump 7 compresses the fuel received from the intake pipe 10 so as to send the fuel at high pressure, for example in the region of 1600 bar, to the common rail 6, via the delivery pipe 8. Each injector 5 is designed to be actuated for performing, in the corresponding cylinder 3, a fuel injection of variable flow rate, i.e., with an amount of fuel that can vary between a minimum value and a maximum value under the control of an electronic control unit 16, which may be formed by the usual microprocessor control unit for controlling the engine 2.

The control unit 16 is designed to receive signals indicating the conditions of operation of the engine 2, such as the position of the accelerator pedal and the r.p.m. of the engine shaft 4, which are detected by corresponding sensors, as well as the pressure of the fuel in the common rail 6, detected by a pressure sensor 17. By processing said received signals by means of an appropriate software, the control unit 16 controls the instant and the duration of the actuation of the individual injectors 5, as well as the regulation solenoid valve 15.

The high-pressure pump 7 comprises one or more pumping elements 18 of the reciprocating-motion type, each formed by a cylinder 19 having a compression chamber 20, in which there slides a piston 21. The compression chamber 20 is in communication with the intake pipe 10, via a intake valve 25, and is in communication with the delivery pipe 8, via a delivery valve 30. The piston 21 is actuated by cam means 22 carried by a shaft 23, with a sinusoidal reciprocating motion comprising a suction stroke and a compression or delivery stroke, as will be more clearly seen hereinafter.

In the example illustrated in FIG. 1, the shaft 23 of the pump 7 is connected to the engine shaft 4 via a device for transmission of motion 26, such as to control a compression stroke for each injection of the injectors 5 into the respective cylinders 3. The shaft 23 may be represented by a shaft provided for actuating other devices of the engine.

Advantageously, in the case of a four-stroke engine, the shaft 23 may be represented by the usual camshaft for control of the intake and exhaust valves of the cylinders 3 of the engine 2. In engines with four or more cylinders, the pump 7 is equipped in general with a number of pumping elements 18, which can be actuated by a common cam. In particular, in the embodiment of FIG. 1, the pump 7 is equipped with two pumping elements 18 arranged diametrically opposite to one another and actuated by a common cam 22.

Figure 3:
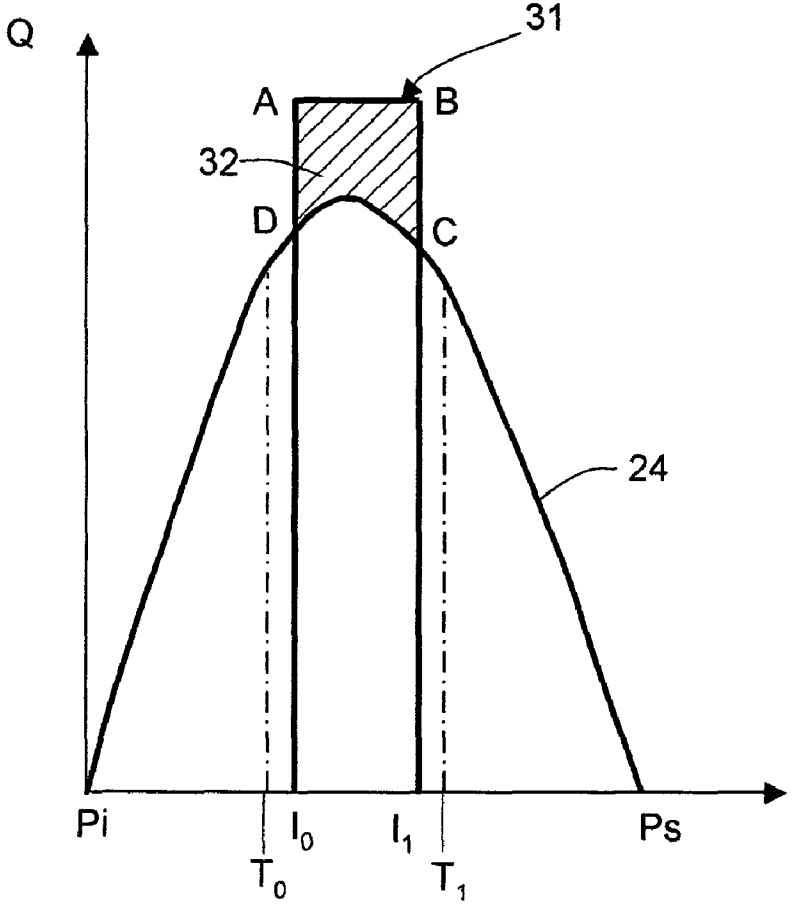
FIG. 3 represents a characteristic diagram of the operation of the injection system of FIG. 1 and FIG. 2.

In the diagram of FIG. 3, the compression stroke of each pumping element 18 is indicated on the abscissa by the segment between a bottom dead centre Pi and a top dead centre Ps. The speed of the pumping element 18 is represented by a sinusoidal curve 24, which consequently represents also the instantaneous flow rate of the pumping element 18 in the absence of the by-pass solenoid valve 14. Consequently, the area under the curve 24 represents the maximum volume of fuel delivered in one pumping stroke. The actuation of an injector 5 for each injection phase in the respective cylinder 3 is represented by a rectangle 31, i.e., $I_0ABI_1$, the base of which on the abscissa is a segment between a starting point Io and an end point I. sub.1, whilst the height indicates the instantaneous flow rate (herein assumed as being constant) of the injector 5. The area of the rectangle $I_0ABI_1$ thus represents the volume of fuel delivered by the injector 5 in its injection phase. Said volume varies both as regards the duration, by varying the position of the points $I_0$ and $I_1$ and as regards the flow rate, by varying the instantaneous flow rate of the injector, i.e., the height of the rectangle 31, for example by varying the pressure of the fuel in the common rail 6.

Figure 4:
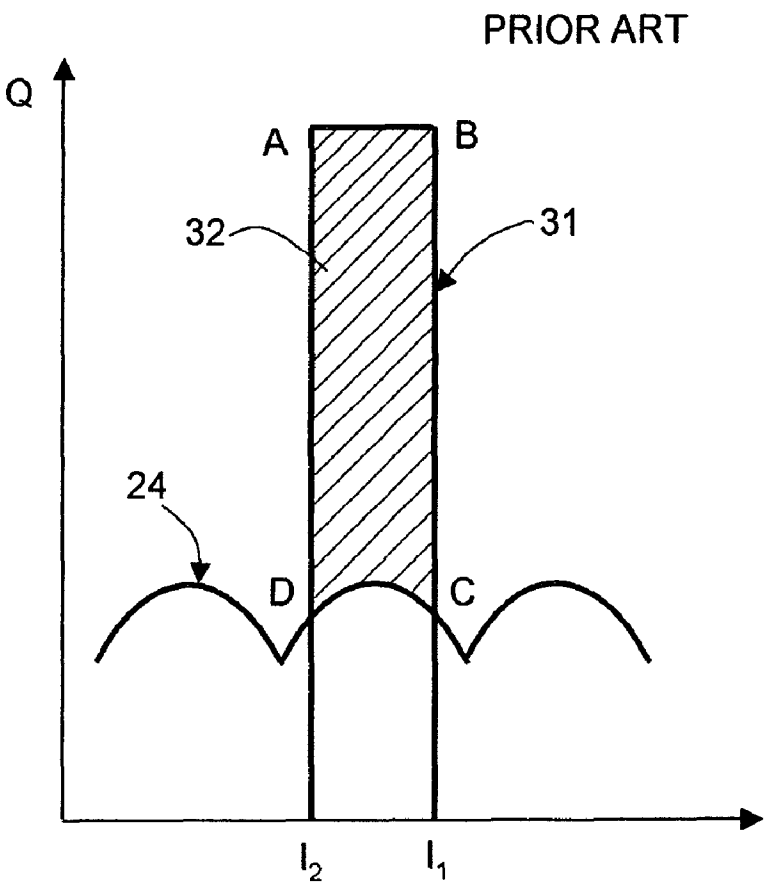
FIG. 4 represents a diagram of the operation of the injection system according to the known art.

In the known art, represented by the diagram of FIG. 4, the volume of fuel $I_0CDI_1$ introduced by the pump during the injection event, of a pumping element 1 is only a fraction of the maximum flow rate of the injector 5, for example only in the region of 20%; so that, under full load of the engine 2, the remaining part ABCD, i.e., 80% of the volume of fuel to be injected, must be supplied by the common rail 6. The rail 6 must thus have a considerable volume so that the pressure of the fuel contained therein does not oscillate too much during each injection event. Furthermore, 80% of the fuel must be supplied by other deliveries of the pumping elements 18, for example by means of a pump with three pumping elements 18, as illustrated in FIG. 4, where the pumping elements 18 work constantly at maximum delivery.

According to the invention, the pumping element 18 has an instantaneous flow rate, the maximum value of which is of the same order of magnitude as the maximum flow rate of each injector 5, as indicated in FIG. 3. In particular, the instantaneous maximum flow rate of the pumping element 18 is equal to at least 50% of the maximum flow rate of the injector 5. Advantageously, the instantaneous maximum flow rate of the pumping element 18 may be chosen between 70% and 90% of the maximum flow rate of the injector 5. The compression stroke Pi-Ps of the pumping element 18 occurs in synchronism with the injection phase of the injector 5. In turn, the by-pass solenoid valve 14 is controlled by the control unit 16 in a chopped way, through a chopper unit 28. Advantageously, the chopper unit 28 is integrated with the control unit 16 and is thus implemented with a corresponding software, but in the drawings it is represented separately for reasons of clarity of description.

The control unit 16 via the chopper unit 28 is designed to control the solenoid valve 14 by means of a PWM logic signal, and at a frequency correlated to the speed of the pump 7. Consequently, the delivery of the pump 7 is carried out only during a part of the compression stroke of the individual pumping element 18 when the by-pass solenoid valve 14 is intercepted or closed. Instead, in the remaining part of the compression stroke, since the by-pass valve 14 is open, the compression chamber 20 is in communication with the tank 11, so that the pump 7 presents a low dissipation of energy. The angle of effective delivery of each pumping element 18 is chosen according to the conditions of operation of the engine 2, i.e., according to the flow rate required by the injectors 5.

In particular, the control unit 16, via the chopper unit 28, is designed for modulating the delivery of the pumping elements 18 in a chopped way, controlling opening of the solenoid valve 14 between an instant $T_0$ of start of delivery during compression and an instant $T_1$ of end of delivery, so as to supply to the delivery pipe 8 the majority (area $I_0DCI_1$ in FIG. 3) of the fuel to be injected in the simultaneous injection of the corresponding injector 5. In this way, the common rail 6 must supply just one minimum amount of fuel (area DABC in FIG. 3), so that the pressure therein is maintained constant even though the accumulation volume of the rail 6 is reduced.

In particular, the instants $T_0$ and $T_1$ correspond to two intermediate points of the compression stroke of the pumping element 18. The control unit 16, via the chopper unit 28, modulates or varies both the instant of start $T_0$ of delivery and the instant of end $T_1$ of delivery. Advantageously, to reduce the displacement of the pump 7, the delivery is symmetrical or barycentric both with respect to the compression stroke Pi-Ps of the pumping element 18 and with respect to the injection phase $I_0$-$I_1$. In this way, the common rail 6 may be designed with very small dimensions or may even coincide with the volume of the high-pressure pipe 8 itself, given that the fuel injected thereby is simultaneously reintegrated according to a diagram equivalent to the diagram of the injection phase.

Figure 2:
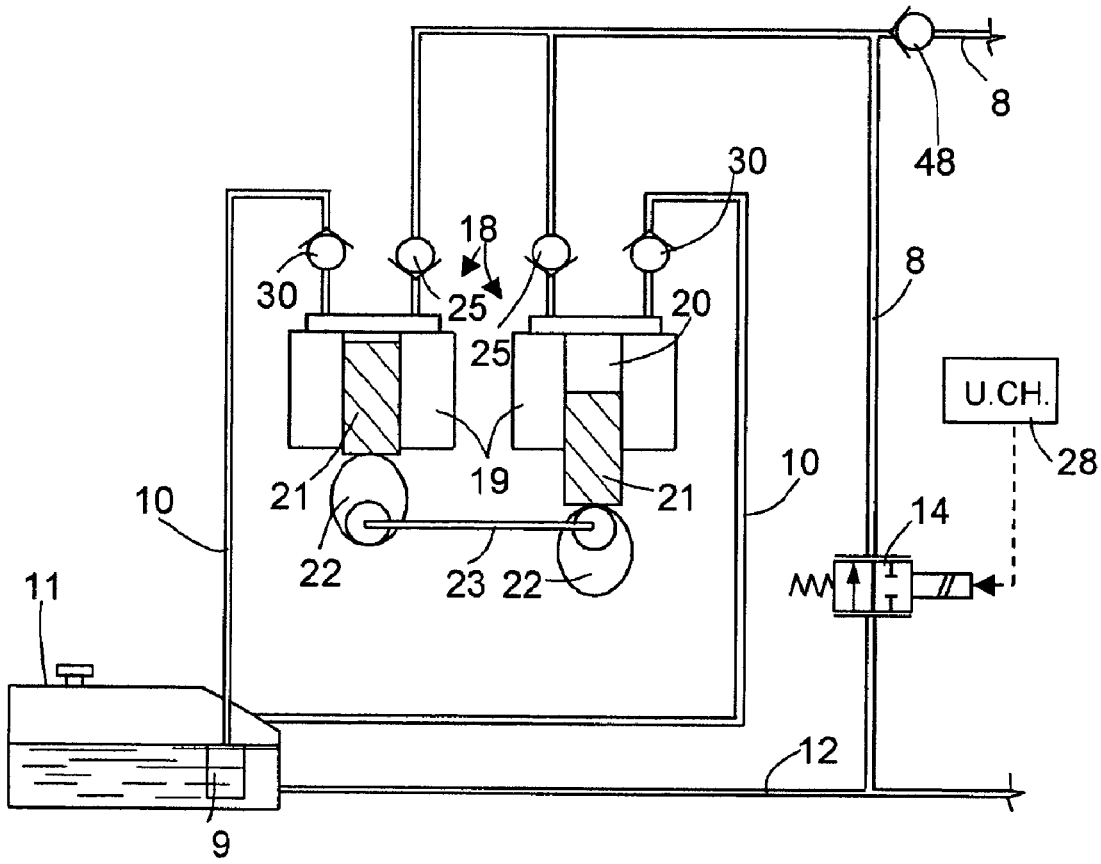
FIG. 2 represents a detail of another embodiment of the injection system of the invention.

According to the embodiment of FIG. 2, the two pumping elements 18 are arranged in line and are actuated by two different cams 22 fixed on the shaft 23 in diametrically opposite positions. The by-pass solenoid valve 14 is also here set on the delivery pipe 8, being associated to a corresponding non-return valve 48.

It is evident that the injection system described above provides a method for controlling the pressure of the fuel in the accumulation volume 6, into which the fuel is supplied by at least one pumping element 18, which moves with reciprocating motion including a compression stroke, through a delivery pipe 8 equipped with a by-pass solenoid valve 14, the method of control including the following steps: providing a pumping element 18 with an instantaneous maximum flow rate of the same order of magnitude as the maximum flow rate of an injection phase of each injector 5, providing a by-pass solenoid valve 14 on a delivery pipe 8 of said pumping element 18, actuating the pumping element 18 in synchronism with said injection phase, and controlling said by-pass solenoid valve 14 for modulating the delivery by varying both its instant of starting $T_0$ and its instant of end $T_1$, in such a way that said delivery is barycentric with respect to said compression stroke Pi-Ps.

In this way, the amount of fuel supplied by the common rail to each injector 5 for each injection phase is reduced to the minimum.

From what has been seen above, the advantages of the injection system according to the invention as compared to the known systems are evident. In particular, since the flow rate of the pumping element 18 is of the same order of magnitude as the maximum flow rate of an injection phase of the injector 5, the fuel supplied by the common rail 6 for injection is normally altogether negligible and is small also when the injector 5 operates at its maximum flow rate. Furthermore, since delivery is carried out simultaneously with injection and is barycentric both with respect to the injection phase and with respect to the compression stroke of the pumping element 18, the common rail 6 can have very small dimensions or be eliminated altogether, with beneficial effects on the layout of the injection system in the engine compartment.

It is understood that various other modifications and improvements may be made to the injection system described herein, without thereby departing from the scope of the claims. For example, the by-pass solenoid valve 14 may be integrated with the pump 7. Furthermore, each pumping element 18 of the pump 7 may be equipped with a by-pass solenoid valve of its own on the corresponding delivery pipe. The high-pressure pump 7 may be constituted by a pump with three or more radial pumping elements, used also in engines with a number of cylinders different from four. Finally, the pump 7 can also be constituted by just one pumping element 18.

We claim:

1. A fuel injection system for an engine, the engine including at least one engine cylinder and operating at a variable engine speed, the fueling system comprising:

a fuel pump for supplying fuel at high pressure, the fuel pump including at least one pumping element and operating at a speed that is proportional to the variable engine speed, the at least one pumping element including a compression phase having an instant of start Pi and an instant of end Ps;

an accumulation volume in communication with the fuel pump and receiving fuel at high pressure therefrom;

a by-pass valve in communication with the fuel pump and the accumulation volume, the by-pass valve operating to intermittently deliver fuel at high pressure from the fuel pump to the accumulation volume, the by-pass valve operating to deliver fuel to the accumulation volume during only a portion of the compression phase such that a fuel delivery instant of start T0 occurs after the compression phase instant of start Pi and a fuel delivery instant of end T1 occurs before the compression phase instant of end Ps; and at least one fuel injector in communication with the accumulation volume and receiving fuel at high pressure therefrom, the at least one fuel injector actuatable independently of the by-pass valve to inject fuel into the engine cylinder during an injection phase that occurs within the compression phase.

2. The fuel injection system of claim 1, wherein a by-pass valve delivery phase is defined between the fuel delivery instant of start T0 and the fuel delivery instant of end T1, wherein the speed of the fuel pump is such that each injection phase of the at least one fuel injector is accompanied by a corresponding compression phase, and wherein the by-pass valve operates whereby each injection phase of the at least one fuel injector is also accompanied by a corresponding by-pass valve delivery phase.

3. The fuel injection system of claim 2, wherein each delivery phase is barycentric with respect to the corresponding compression phase.

4. The fuel injection system of claim 2, wherein each delivery phase is barycentric with respect to the corresponding injection phase.

5. The fuel injection system of claim 1, wherein the at least one pumping element includes a plurality of pumping elements and the at least one injector includes a plurality of injectors, and wherein an instantaneous maximum flow rate of each pumping element is equal to at least 50% of a maximum flow rate of each injector.

6. The fuel injection system of claim 1, further comprising a control unit for controlling operation of the by-pass valve, the control unit operating the by-pass valve to modulate the instant of start T0 and instant of end T1 at a frequency correlated to the speed of the fuel pump.

7. The fuel injection system of claim 1, wherein the compression phase includes an instant of maximum instantaneous flow rate, and wherein a fuel delivery duration defined as the time between the instant of start T0 and the instant of end T1 is centered in time with respect to the instant of maximum instantaneous flow rate.

8. A fuel injection system for an engine including at least one engine cylinder and operating at a variable engine speed, the fuel injection system comprising:

a fuel pump for supplying fuel at high pressure, the fuel pump including at least one pumping element and operating at a speed that is proportional to said variable engine speed, the at least one pumping element operating through a reciprocating motion including a compression phase having an instant of start Pi and an instant of end Ps;

an accumulation volume in communication with the fuel pump and receiving fuel at high pressure therefrom;

a by-pass valve in communication with the fuel pump and the accumulation volume, the by-pass valve being operated to modulate a delivery phase of fuel at high pressure from the fuel pump to the accumulation volume;

a control unit for controlling the by-pass valve to modulate an instant of start T0 and an instant of end T1 of the delivery phase at a frequency correlated to the speed of said fuel pump, the instant of start T0 and the instant of end T1 of the delivery phase occurring during the compression phase, the instant of start T0 occurring after the compression phase instant of start Pi; and at least one fuel injector in communication with the accumulation volume and receiving fuel at high pressure therefrom, the at least one fuel injector being controlled by said control unit to inject fuel into the engine cylinder during an injection phase independently from the instant of start TO and the instant of end T1 of the delivery, the injection phase starting and ending during the compression phase.

9. The fuel injection system of claim 8, wherein the speed of the fuel pump is such that each injection phase of the at least one fuel injector is accompanied by a corresponding compression phase, and wherein the by-pass valve operates whereby each injection phase of the at least one fuel injector is also accompanied by a corresponding delivery phase.

10. The fuel injection system of claim 8, wherein the compression phase includes an instant of maximum instantaneous flow rate and the delivery phase includes a duration, and wherein the duration is centered in time with respect to the instant of maximum instantaneous flow rate.

11. The fuel injection system of claim 8, wherein the instant of end T1 of the delivery phase occurs before the compression phase instant of end Ps.

12. A fuel injection system for an engine, the engine including at least one engine cylinder and operating at a variable engine speed, the fuel injection system comprising:

a fuel pump for supplying fuel at high pressure, the fuel pump including at least one pumping element and operating at a speed that is proportional to said variable engine speed, the at least one pumping element including a compression phase having an instant of start Pi, an instant of end Ps, and an instant of maximum instantaneous flow rate;

an accumulation volume in communication with the fuel pump and receiving fuel at high pressure therefrom;

a by-pass valve in communication with the fuel pump and the accumulation volume, the by-pass valve operating to deliver fuel at high pressure from the fuel pump to the accumulation volume during a delivery phase, the delivery phase having an instant of start T0 and a duration, the instant of start T0 occurring after the instant of start Pi and the duration centered in time with respect to the instant of maximum instantaneous flow rate; and at least one fuel injector in communication with the accumulation volume and receiving fuel at high pressure therefrom, the at least one fuel injector actuateable independently of the by-pass valve to inject fuel into the engine cylinder during an injection phase that occurs during the compression phase.

13. The fuel injection system of claim 12, wherein the speed of the fuel pump is such that each injection phase is accompanied by a corresponding compression phase, and wherein the by-pass valve operates whereby each injection of fuel by the at least one fuel injector is also accompanied by a corresponding delivery phase.

* * * * *